United States Patent [19]

Kosrow

[11] Patent Number: 4,531,721

[45] Date of Patent: Jul. 30, 1985

[54] AUTOMATIC TRANSFER APPARATUS

[75] Inventor: Robert L. Kosrow, Hoffman Estates, Ill.

[73] Assignee: Union Special Corporation, Chicago, Ill.

[21] Appl. No.: 545,806

[22] Filed: Oct. 26, 1983

[51] Int. Cl.[3] ..... B42C 1/00

[52] U.S. Cl. ..... 270/45; 112/262.3; 198/486

[58] Field of Search ..... 270/45; 112/262.3; 271/18; 198/486; 33/133, 127; 493/405, 408, 416, 417, 422, 451

[56] References Cited

U.S. PATENT DOCUMENTS

| | | | |
|---|---|---|---|
| 3,550,789 | 12/1970 | Jaeger et al. | 198/486 |
| 3,773,002 | 11/1973 | Burton | 112/262.3 |
| 4,394,740 | 7/1983 | Shalon | 33/133 |
| 4,428,315 | 1/1984 | Keeton | 112/262.3 |
| 4,444,384 | 4/1984 | Keeton | 271/18.3 |

FOREIGN PATENT DOCUMENTS

| | | | |
|---|---|---|---|
| 147565 | 12/1978 | Japan | 33/133 |

*Primary Examiner*—E. H. Eickholt
*Attorney, Agent, or Firm*—John W. Harbst; John A. Schaerli

[57] ABSTRACT

An automatic transfer apparatus for delivering textile articles from a first conveyor to a second conveyor; each conveyor moving the articles in separate directions. The apparatus includes an article gripping head mounted for pivotal movement between two positions and a drive mechanism. The apparatus operates such that the article is removed from the first conveyor, subsequently folded in half about its midpoint and deposited on the second conveyor with substantially no horizontal velocity component being imparted to the workpiece in the direction of the first conveyor system.

15 Claims, 7 Drawing Figures

AUTOMATIC TRANSFER APPARATUS

FIELD OF THE INVENTION

This invention generally relates to a delivery system for textile articles or workpieces and, in particular, to a new and preferred device of this general class.

BACKGROUND OF THE INVENTION

Automation of the different phases in textile manufacturing is in great demand, particularly for the timely manipulation and transfer phases. From a manufacturer's viewpoint, automation is attractive in terms of labor and elimination of manual work. Automation also eliminates repetition which may make the manual tasks tedious.

Accordingly, in his patent application Ser. No. 319,671 filed Nov. 9, 1981, now U.S. Pat. No. 4,428,315, John H. Keeton describes an automatic method and apparatus for assembling textile workpieces. More particularly, Mr. Keeton discloses an improved method for automatically making sleeves. In his application, Mr. Keeton describes a transfer apparatus for moving a textile workpiece from one conveyor to another. This is one of the key components in the patented apparatus to proper article manufacture. More particularly, the ability of the apparatus to correctly position the article on the second conveyor is very important. A continual problem has been to deposite the workpiece on the second conveyor in a manner assuring the general alignment of the workpiece edges for subsequent operations.

SUMMARY OF THE INVENTION

With the above in mind, and in keeping with the present invention, there is provided an automatic transfer apparatus which is an improvement over that disclosed in the above-identified patent application. The present invention finds utility with a conveyance system including a first conveyance means for moving a workpiece in a first direction and a second conveyance means arranged at the end of the first conveyance means for moving the workpiece in a separate second direction. The work pick up apparatus of the present invention being disposed at the interface of the first and second conveyance means. The present invention is provided with a gripping head, a support means for moving the gripping head both in horizontal and vertical directions, with the horizontal direction extending generally parallel with the advancing direction of the first conveyance means, and drive means for moving the gripping head.

The uniqueness of the invention is founded in its operation. The pick up head or gripping means seizes the article from the first conveyor and transfers it, in a folded state, to a second conveyor. The seizure and release of the workpiece is accomplished through a control system which includes: a sensor for detecting the leading and trailing workpiece edges; a speed sensor which measures the advance rate of the conveyance means; and a third sensor which provides a signal indicative of the position of the gripping head relative to the conveyance means. This control system releases the workpiece over the second conveyor such that the overlapping unsewn edges of the workpiece are arranged proximate a longitudinal edge of the second conveyor with substantially no velocity component being imparted to the workpiece in the advancing direction of the first conveyance means. Because no velocity component is imparted to the workpiece, control over the workpiece is better maintained and the alignment of the edges, which are to be subsequently operated upon, is better assured. With control of the workpiece edges being accomplished, subsequent operations are enhanced. Furthermore, and as a skilled artesian may appreciate, with the release of the gripping head being controlled, the article may be controllably transferred as a function of the workpiece's length.

In line with all of the above, the primary object of this invention is the provision of a workpiece transfer apparatus which is capable of removing a textile workpiece from a first conveyance means, folding and transferring the workpiece to a second conveyance means, and depositing the folded workpiece on the second conveyance means with its unsewn edges proximate to a longitudinal edge of the second conveyance means and with substantially no velocity component being imparted to the workpiece in the direction of the first conveyance means.

Another object of the present invention is the provision of an automatic transfer apparatus which is simple in construction and efficient in operation.

BRIEF DESCRIPTION OF THE DRAWINGS

Having in mind the above objects and other attendent advantages that would be evident from an understanding of the disclosure, the invention comprises the devices, combinations, and arrangements of parts as illustrated in the presently preferred form of the invention which is hereinafter set forth in detail to enable those skilled in the art to readily understand the function, operation, construction and advantages of same when read in conjunction with the accompanying drawings in which.

DETAILED DESCRIPTION OF THE PRESENT INVENTION

Figure 1:
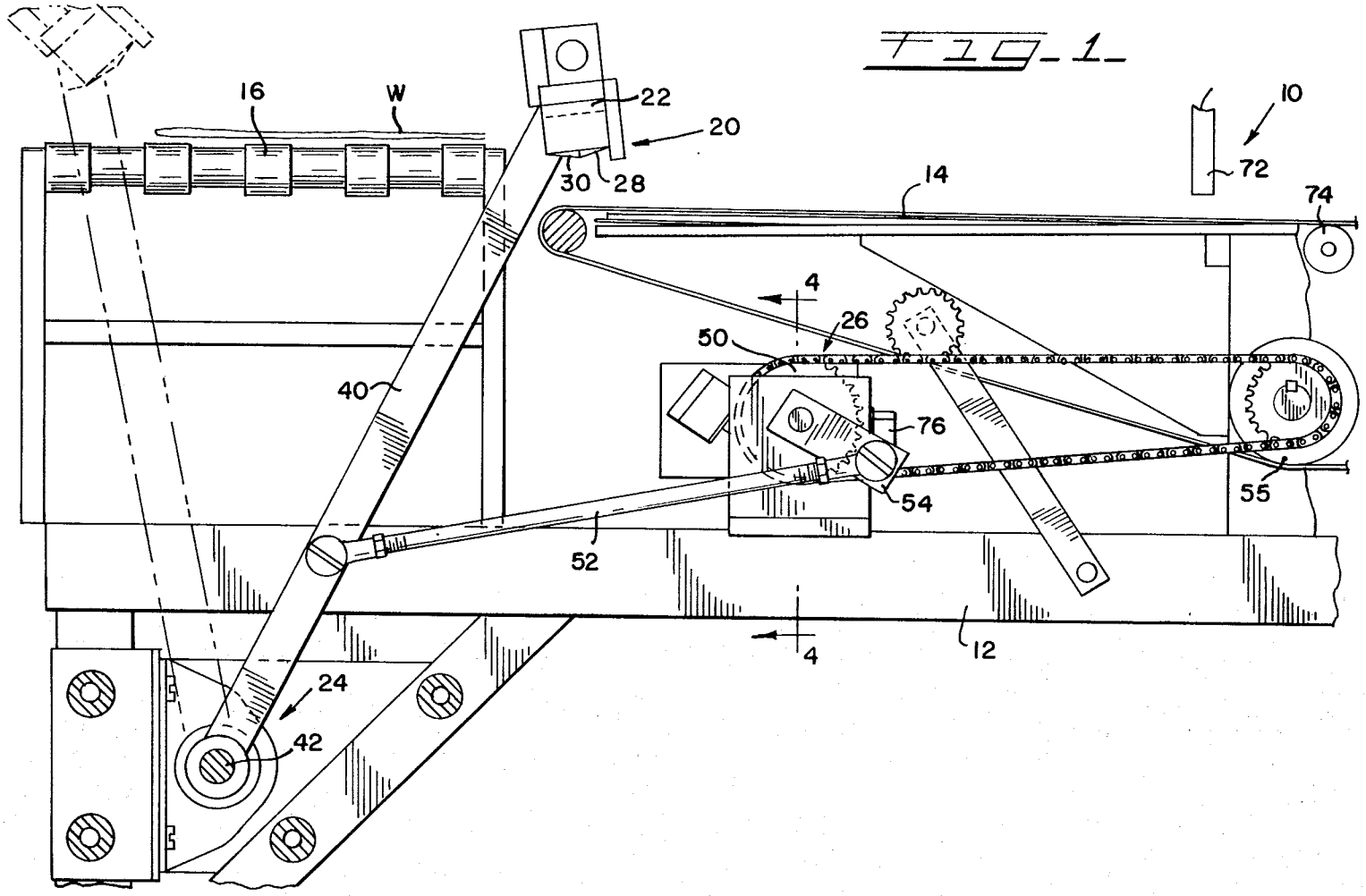
FIG. 1 is a partial side schematic view of the present invention.
Figure 2:
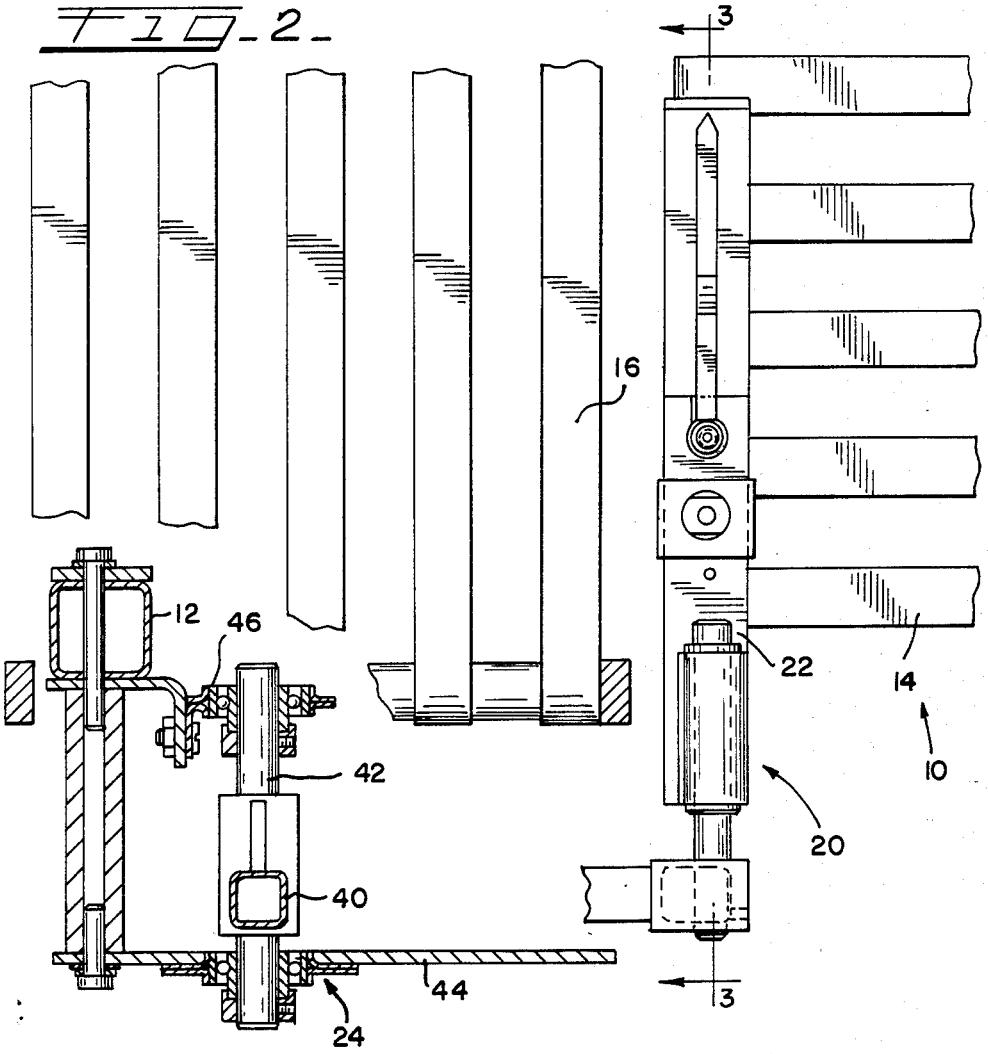
FIG. 2 is a partial top plan view, partly in section, of the present invention.

Referring now in greater detail to the various figures of the drawings, wherein like reference numerals indicate like parts, there is generally shown at 10 in FIGS. 1 and 2, a material delivery system. The delivery system includes a generally L-shaped frame 12 each leg of which is provided with an endless conveyance means 14 and 16. The conveyance means 14 is adapted to move a workpiece in a first direction while the conveyance means 16 moves the workpiece in a second separate direction. Each conveyance means is adapted to move successive workpieces in a elongated planar path and comprises a series of laterally spaced endless belts which are continuously driven from a common drive means.

Figure 3:
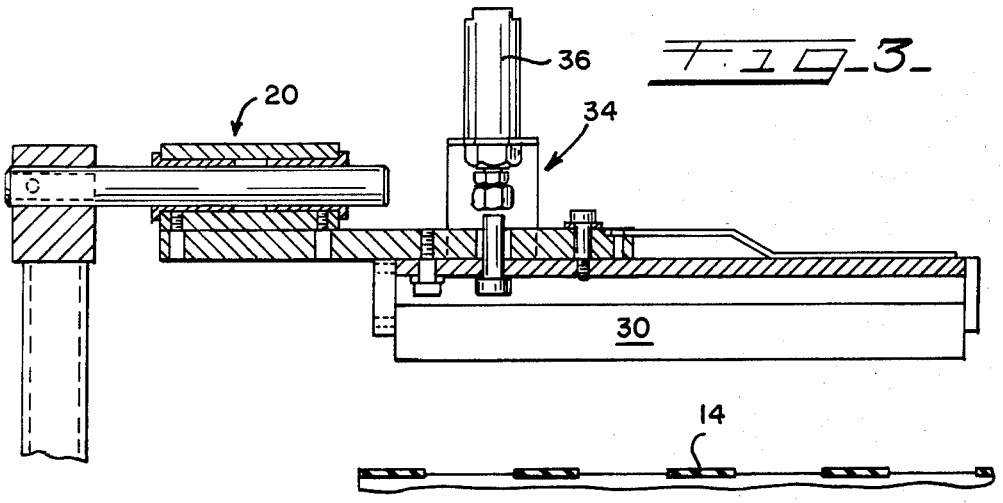
FIG. 3 is a side sectional view taken along line 3—3 of FIG. 2.

Preferably, the workpieces W (FIG. 1), which may be of fabric or other sheet material are: successively conveyed in a first direction on the first conveyance means; folded and transferred to the second conveyance means; subsequently conveyed in a second direction on the second conveyance means. To accomplish this sequential operation, a pick up apparatus 20 is disposed at the interface of the first and second conveyance means. The primary operative elements of the transfer device 20 include pincer or gripping head means 22; a support means 24 and a drive mechanism 26. The pincer means 22 may be of the type described in U.S. patent application Ser. No. 283,977 filed July 16, 1981 in the name of John H. Keeton, now U.S. Pat. No. 4,444,384, the full disclosure of which in incorporated herein by reference. Suffice it to say, the pincer means may include spring biased jaws 28 and 30 (FIG. 1). The jaws are movable toward and away from one another in a substantially horizontal plane and are capable of holding a workpiece portion therebetween. An actuable mechanism generally identified as 34 in FIG. 3, serves to close and open the grasping members of the pick up device. The actuatable mechanism includes a driver 36, operable in response to a signal, for controlling the disposition of the grasping members 28 and 30 relative to the workpiece.

In the preferred embodiment, and as best seen in FIG. 1, the gripping head is moved from a first position, shown in solid lines, overlying the first conveyance means toward the conveyance means whereat it seizes the workpiece from whence it moves to a second position, shown in dotted lines, overlying the second conveyance means. During its movement, the grasping assembly 22 has both horizontal and vertical components of movement for effecting the article or workpiece transfer from one conveyor to another while concurrently folding same about itself. The horizontal component of movement of the gripping head extends in a direction generally parallel with the direction of advancement of the first conveyance means.

The grasping assembly 22 is carried at one end of the support means 24. In its preferred form, the support means 24 includes an extended actuatable arm 40. The grasping means is operatively secured at one end of the arm. At its other end, the arm 40 rotates about a horizontal axis of a stub shaft 42. As best seen in FIG. 2, the shaft 42 extends generally parallel to and along the advancement direction of the second conveyance means. The shaft 42 is supported at each of its ends. A support plate 44 attached to the frame 12 secures one end of the shaft. The other end of shaft 42 is supported in an adjustable bearing block 46 carried by the frame 12. As a skilled artesian will readily appreciate, the height wise adjustment of the bearing block 46 relative to the frame 12 provides for planar adjustment of the head 22 relative to the first conveyance means.

Figure 4:
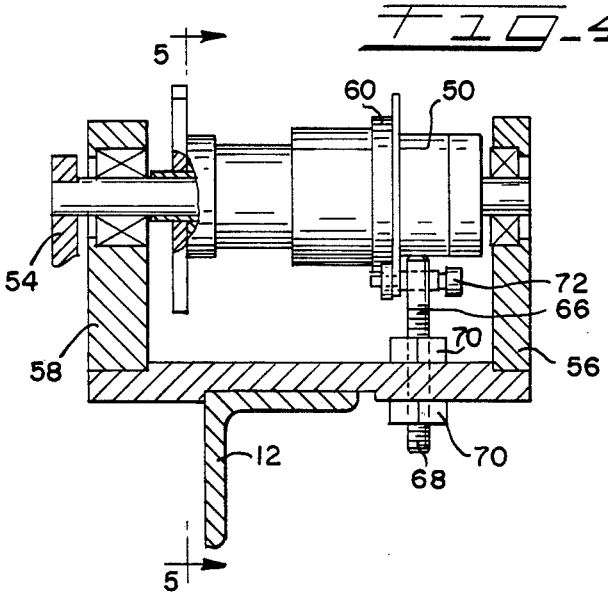
FIG. 4 is a side sectional view schematically illustrating the drive mechanism of the instant invention.
Figure 6:
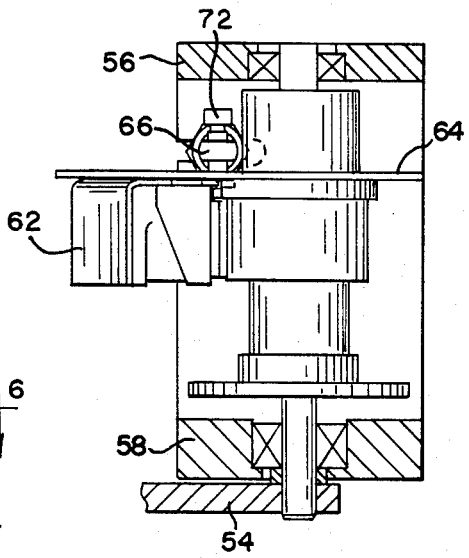
FIG. 6 is a top plan view, partly in section, taken along line 6—6 of FIG. 4.
Figure 5:
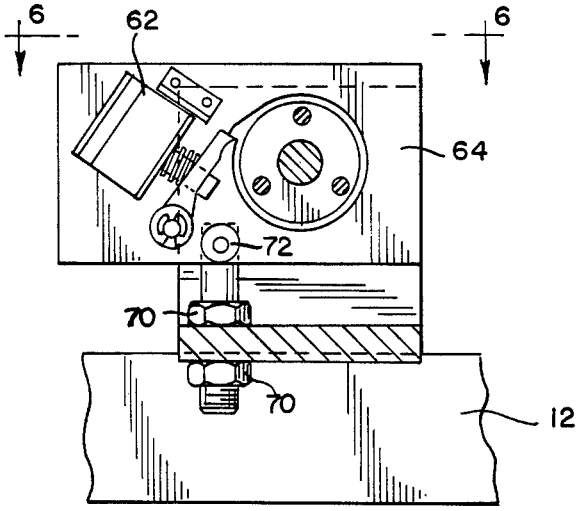
FIG. 5 is a side sectional view taken along line 5—5 of FIG. 4.

The drive mechanism means 26 for moving the pick up head means through the course of the cycle will now be described. As best seen in FIG. 1, the support arm 40 is operatively associated with a power source 50 as by arms 52 and 54. Turning to FIGS. 4 through 6, the power source 50 may be comprised of an electrically actuated clutch mechanism. The clutch mechanism and the first conveyor means are both driven by a continuously rotating common drive means or source of power 55. The clutch mechanism has an arm 54 attached at the output end thereof. The clutch mechanism may be of the type sold by Warner Electric Brake and Clutch Company under Model No. CB-5. Such a clutch incorporates in a single control package all the components that are necessary to accurately start and stop the arm 54 whereby ultimately positioning the pick up means 22. The clutch mechanism operates from a pulse, stopping the arm at any predetermined angular increment within $\pm\frac{1}{2}°$ of the desired point.

As best seen in FIGS. 4 through 6, the rotation control package 50 is carried on the frame 12 between two upstruck members 56 and 58. The power source comprises a clutch brake with stop collar 60 and solenoid actuated means 62. The clutch brake with stop collar and solenoid actuator are carried on a mounting plate 64. An adjusting member 66 serves to control the disposition of the mounting plate 64.

The adjusting member includes a threaded member 68 whose heightwise adjustment is controlled by two fasteners 70. At its upper end, the threaded member is provided with a radially projecting shouldered pin 72 that passes through and secures the mounting plate against rotation but which permits axial or endwise displacement of the clutch assembly. By this construction, the heightwise adjustment of the adjusting member ultimately controls the angular disposition of the drive arm 54 and, thus, the home position of the grasping member 22.

Figure 7:
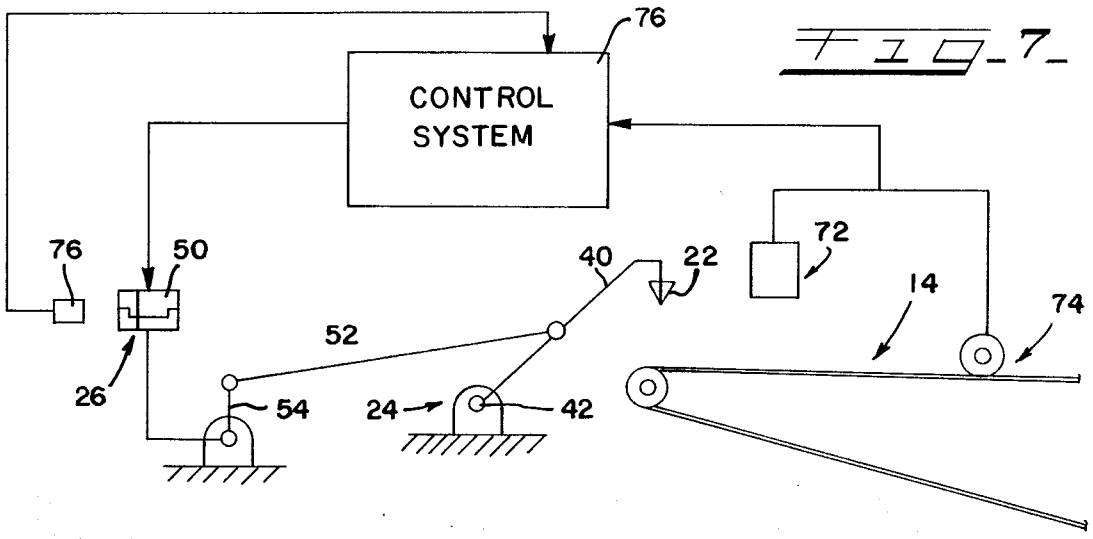
FIG. 7 is a schematic illustration of the means for controlling the pick up and transferring mechanism.

The drive mechanism means 26 responds to a electromechanical workpiece measuring apparatus means. The measuring means includes a sensing device 72 and a sensor 74. The sensing device 72 may be in the form of a photo responsive means or other suitable means capable of detecting the passage of the leading and trailing edges of the workpiece past a predetermined position. The sensor 74 may be in the form of any suitable means capable of measuring the linear advancement of the material conveyance means 14. As seen in FIG. 7, the outputs of both the sensing device 72 and the sensor 74 are operatively connected to electrical circuitry means 76 capable of calculating the length of the advancing workpiece from the signals received from the sensors. The output of the electrical circuitry means 76 forms a control means or system effective to cause initiation of the work transfer from the first conveyor and subsequent deposit of same on to the second conveyor. Another sensor means 76 (FIGS. 1 and 7) may be arranged on the drive mechanism 26. The purpose of this sensor is to provide a reference signal to the electrical circuitry means indicative of the position of the drive arm 54 and ultimately the position of the gripping head. The release of the workpiece from the gripping head is timed from this reference signal. That is, this reference signal, when combined with the calculated workpiece length information, controls the point at which the workpiece will be released from the gripping head. The subsequent deposit of the workpiece on the second conveyor is controlled by delivering a signal to the driver of the gripping head whereby releasing the jaws from the clamping relationship with the workpiece and thereby releasing the workpiece.

In operation, the leading edge of the workpiece is detected by the sensor means 72. Subsequently, the trailing edge of the workpiece is detected by the sensor means 72. The time difference between the two is computed and stored. Additionally, the advance rate of the first conveyance means is computed. A signal, derived from computing the product of the time difference and the conveyor speed is timely delivered to the drive mechanism 26 and more particularly to the clutch mechanism. As a result, the driver 26 moves gripper means 22 into contact with the midpoint of the workpiece and is subsequently moved in a direction extending parallel to the first conveyance means. A reference signal from the sensor 76 advises the electrical circuitry means or control system when the head 22 has engaged the workpiece. Ultimately, the gripper means 22 are driven into a second position overlying the second conveyance means 16. The movement of the arm allows the workpiece to fold in half about itself. In this manner, the open unsewn workpiece edges may be subsequently closed whereby forming a tube or sleeve.

In its movement toward the second position, it is important that the workpiece be released from the gripper members with substantially no velocity component being imparted to the workpiece in the direction of the first conveyance means. To accomplish this end, the driver 36 for the jaws is controlled such that the workpiece is released from the jaws when the arm 40 has practically reached the extreme limit of its travel before returning to its home position. The time factor to accomplish this is controlled by the control means described above. In this manner, the workpiece is released from the jaws at a point whereat substantially no horizontal velocity component will be imparted to the workpiece in the direction of the first conveyance means thereby assuring proper workpiece placement of the second conveyor. Moreover, the storage of the workpiece length information derived from calculating the workpiece length allows deposit of the folded workpiece blank on the second conveyor as a function of the workpiece's length.

Thus, there has been provided an Automatic Transfer Apparatus which fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Thus, having adequately described my invention, what I claim is:

1. In combination with a conveying system including a first conveyance means for moving a workpiece in a first direction, a second conveyance means arranged at one end of said first conveyance means for moving the workpiece in a second direction, workpiece pick up apparatus disposed at the interface of said first and second conveyance means, said pick up apparatus comprising:

pincer means including two relatively movable jaws capable of holding a workpiece portion therebetween;

means for moving said pincer means from a first workpiece engaging position in an arcuate path and ending in a second position overlying the second conveyance means whereby folding the workpiece upon itself;

means operable upon said pincer means reaching the extreme limit of its arcuate movement away from said first conveyance means such that the folded over edges of the workpiece are deposited on said second conveyance means closely adjacent a longitudinal edge thereof with substantially no velocity component being imparted to the workpiece in the direction of the first conveyance means.

2. The invention according to claim 1 wherein said means for moving includes a support arm operatively connected at one of its ends to said pincer means and pivotally supported at its other end.

3. The invention according to claim 1 wherein said moving means includes a pivotal arm having said pincer means arranged at one end thereof with an electric clutch means adapted to drive said pivotal arm.

4. The invention according to claim 1 wherein the rotatable axis for said pincer means extends generally parallel to and along the advancement direction of said second conveyance means.

5. Apparatus for transferring a workpiece from a first continuously moving conveyor means to a second continuously moving conveyor means, comprising:

a pick up head means movable from a first position whereat the head means engages a workpiece arranged on the first conveyor means about an axis extending substantially perpendicular to the direction of advancement of the first conveyor means to a second position arranged above said second conveyor means;

drive means connected to said pick up head means for effecting the movement thereof from one position to the other whereby folding the workpiece upon itself; and means for releasing the head means engagement with the workpiece such that the released workpiece is positioned on said second conveyor means with its overlapping edges arranged closely adjacent a longitudinal edge of the second conveyor means and with substantially no velocity component being imparted to the workpiece in the direction of the first conveyor means.

6. Apparatus according to claim 5 wherein said drive means includes a clutch driven apparatus.

7. The apparatus according to claim 5 further characterized by said workpiece positioned on said second conveyor means is a hemmed fabric workpiece.

8. The apparatus according to claim 5 wherein the first continuously moving conveyor means and the clutch driven apparatus are driven from common drive means.

9. An automatic apparatus for transferring articles from one conveyor extending in a first direction to another conveyor extending in a second direction, comprising:

a gripping head;

drive means for cyclically moving said gripping head to transfer an article from one conveyor to the other, the workpiece transfer including moving the gripping head in the direction of the first conveyor between a forward position whereat the gripping head engages the article to be transferred and a rearward position whereat the article is released from said gripping head, with the article being folded upon itself during the transference process; and means for controlling the release of the article from such gripping head such that the overlapping edges of the transferred article are deposited closely adjacent a longitudinal edge of the other conveyor with substantially no velocity component being imparted to the workpiece in the direction of movement of the gripping head moving means.

10. The invention of claim 9 wherein said control means includes a detection means for supplying a signal indicative of the position of said gripping head.

11. The invention of claim 9 wherein said control means causes said drive means to move the gripping head from a home position through its forward and rear positions and back to its home position during each sucessive cycle.

12. The invention of claim 9 wherein said gripping head includes at least two elements movable toward and away from each other in a substantially horizontal direction.

13. In a work transfer apparatus including a generally L-shaped frame with each leg of said frame having a conveyor means adapted to support a workpiece, an automatic transfer mechanism for transferring the workpiece from one conveyor means to another, said automatic transfer mechanism comprising:

work gripping means for seizing a workpiece and which is horizontally and vertically movable to transfer the workpiece from one conveyor means to another while concurrently folding same about itself; means for calculating the length of the workpiece; and means for releasing said workpiece from said work gripping means unto said another conveyor such that the workpiece is controllably transferred as a function of the workpiece's calculated length.

14. In combination with a conveying system including a pair of endless conveyors arranged for moving a fabric workpiece along a generally planar path in at least two divergent directions, a pick up device comprising:

a releasable workpiece transporting mechanism capable of engaging and removing the workpiece from one conveyor and depositing same on the other conveyor in a folded state; and means for controlling the release of said workpiece such that the overlapping workpiece edges are deposited closely adjacent a longitudinal edge of the second conveyor with substantially no velocity component being imparted to the workpiece in the advancing direction of the first conveyor.

15. In combination with a conveying system including a first conveyance means for moving a workpiece in a first direction, a second conveyance means arranged at one end of said first conveyance means for moving a workpiece in a second direction, workpiece pick up apparatus disposed at the interface of said first and second conveyance means, said pick up apparatus comprising:

releasable workpiece engagable means for removing the workpiece from said first conveyance means and subsequently depositing same on said second conveyance means in a folded state; and means for controlling the release of said workpiece engaging means such that the overlapping workpiece edges are deposited proximate a longitudinal edge of the second conveyor means with substantially no velocity component being imparted to the workpiece in the direction of the first conveyance means.

* * * * *